United States Patent [19]

Suzuki et al.

[11] Patent Number: 4,687,614

[45] Date of Patent: Aug. 18, 1987

[54] PROCESS FOR PRODUCING A HIGH INTEGRITY CONTAINER

[75] Inventors: Osamu Suzuki; Kanjiro Ishizaki, both of Saitama; Seiichi Ozawa, deceased, late of Tokyo, all of Japan, by Yoshiko Ozawa, heiress

[73] Assignees: Chichibu Cement Co., Ltd.; Ozawa Concrete Industry Co., Ltd., both of Japan

[21] Appl. No.: 733,902

[22] Filed: May 14, 1985

Related U.S. Application Data

[60] Continuation-in-part of Ser. No. 631,185, Jul. 16, 1984, abandoned, which is a division of Ser. No. 473,132, Mar. 7, 1983, Pat. No. 4,594,513.

[30] Foreign Application Priority Data

Nov. 8, 1982 [JP] Japan ..... 57-195758

[51] Int. Cl.[4] ..... B28B 21/36; B28B 21/56

[52] U.S. Cl. ..... 264/40.1; 264/102; 264/129; 264/269

[58] Field of Search ..... 264/101, 102, 129, 269, 264/40.1

[56] References Cited

U.S. PATENT DOCUMENTS

| | | | |
|---|---|---|---|
| 3,727,060 | 4/1973 | Blum . | |
| 3,763,542 | 10/1973 | Gutnajer | 29/400 |
| 3,801,358 | 4/1974 | Steinberg | 117/113 |
| 3,850,661 | 11/1974 | Dreher | 117/123 D |
| 3,972,969 | 8/1976 | Rio et al. | 264/42 |
| 3,975,479 | 8/1976 | McClean | 264/102 |
| 4,060,953 | 12/1977 | Milne | 52/743 |
| 4,109,033 | 8/1978 | Blankenhorn | 427/314 |
| 4,133,928 | 1/1979 | Riley | 428/255 |
| 4,153,743 | 5/1979 | Caramanian | 427/136 |
| 4,169,909 | 10/1979 | Milne | 427/294 |
| 4,222,889 | 9/1980 | Werpmann | 53/474 X |
| 4,257,912 | 3/1981 | Fleischer et al. | 106/99 X |
| 4,263,372 | 4/1981 | Emmons | 428/446 |
| 4,314,957 | 2/1982 | Ozawa | 264/102 |
| 4,443,496 | 4/1984 | Obitsu | 427/140 |

FOREIGN PATENT DOCUMENTS

| | | | |
|---|---|---|---|
| 281719 | 10/1979 | Fed. Rep. of Germany . | |
| 1438241 | 10/1964 | France . | |
| 2231079 | 12/1974 | France . | |
| 2432198 | 2/1980 | France . | |
| 53-148698 | 12/1978 | Japan | 250/506.1 |
| 53-148699 | 12/1978 | Japan | 250/506.1 |
| 1046848 | 10/1966 | United Kingdom . | |
| 653238 | 3/1979 | U.S.S.R. | 264/129 |
| 689991 | 10/1979 | U.S.S.R. | 264/101 |

OTHER PUBLICATIONS par J. Rodier et al, Le conditionnement des matieres de rebut solides faiblement actives du Centre de Marcoule, Bulletin d'Informations Scientifiques et Techniques, (1963.02), 69, 27 t/m 35.

*Primary Examiner*—Jan Silbaugh
*Assistant Examiner*—Leo B. Tentoni
*Attorney, Agent, or Firm*—Browdy and Neimark

[57] ABSTRACT

A high integrity container having a three-layered structure that is suitable as a container for use in storage and disposal of radioactive wastes or industrial wastes can be fabricated by casting a concrete lining as an inner layer on the inner surface of a metallic vessel as an outer layer, reinforcing the concrete lining with a reinforcing material and strengthening the concrete lining with an impregnant, and polymerizing and curing the impregnant layer that is formed as an intermediate layer between said metal drum and the concrete lining.

14 Claims, 4 Drawing Figures

Fig. 4 RESULT OF ACID RESISTANCE TEST
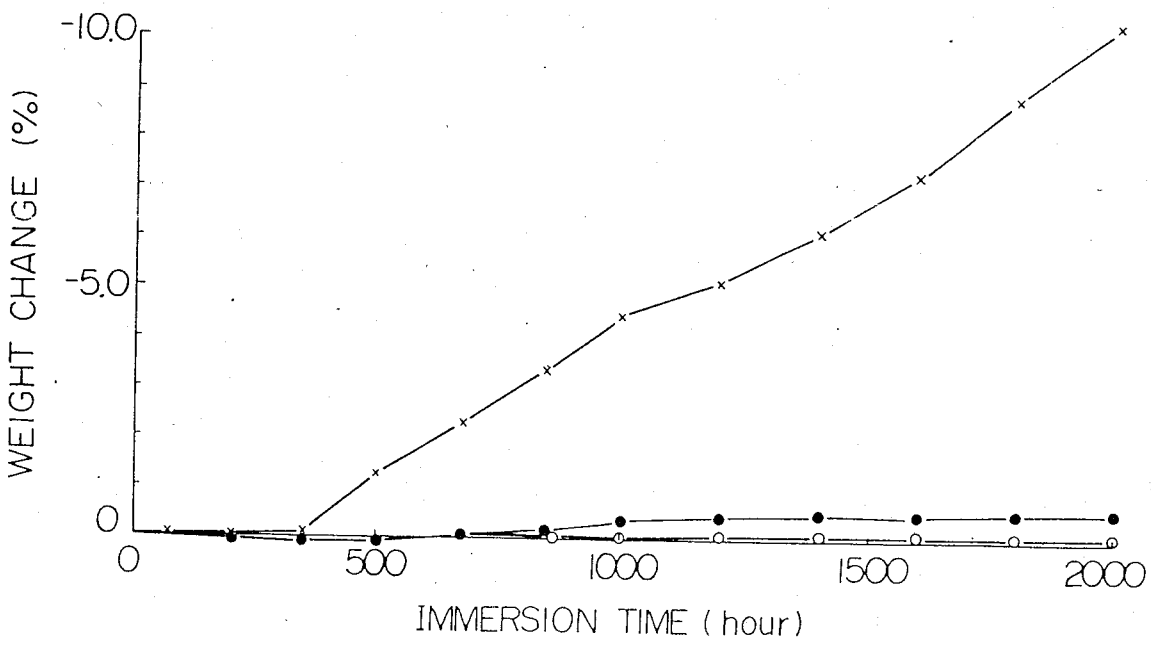

PROCESS FOR PRODUCING A HIGH INTEGRITY CONTAINER

This application is a continuation-in-part application of U.S. Ser. No. 631,185, filed July 16, 1984, now abandoned, itself a division of application Ser. No. 473,132, filed Mar. 7, 1983, now U.S. Pat. No. 4,594,513.

BACKGROUND OF THE INVENTION

1. Field of the Invention

The present invention relates to a process for producing a high integrity container having a three-layered wall structure.

2. Description of the Prior Art

With the continuous increase in the amounts of various radioactive wastes generated from nuclear power plants and other nuclear facilities, as well as harmful heavy metal sludges issued from chemical plants, operators and researchers are making every effort to develop safe and economical ways to store and finally dispose of these wastes.

Radioactive substances differ from heavy metals in that individual nuclides have their own half-lives and need to be isolated from the biosphere for limited periods. In the current nuclear fuel cycle that involves nuclear fission, most of the long-lived wastes originate from the spent fuel reprocessing stage. Beat- and gamma-emitting radioisotopes such as $^{90}Sr$ and $^{137}Cs$ have half-lives of several hundred years, and alpha-emitting transuranics having atomic numbers of 93 or more have estimated half-lives of hundreds of thousands of years. These radioisotopes are typically discharged as high-level radioactive wastes, and most commonly, they are first stored temporarily as liquids, then solidified by suitabel methods, and permanently stored by various engineering techniques, and subsequently disposed of as required. Intermediate and low level wastes, however, are discharged in far greater amounts than high level wastes and it is generally understood that their half-lives are not more than about a hundred years. In other words, ideal containers for surface storage of low and intermediate level radioactive wastes should confine them safely for at least about a hundred years.

Most of the currently used containers for storing and disposing of low and intermediate level radioactive wastes are based on soft steel drums (hereunder simply referred to as metal drums). In actual operations, these wastes are uniformly compacted or solidified with cement, asphalt or plastics in metal drums. The metal drums are simple to use, relatively inexpensive and have been used successfully in many plants for near-term storage, but they corrode in only about 7 years and are not suitable for long-term storage. When the metal drums stored indoors corrode, not only do they become difficult to handle but also they may cause radiation exposures to personnel, and hence radiation contamination of the biosphere. Stainless steel drums are not practical because, for one thing, they are expensive, and for another, in the long run they are gradually corroded by, for example chlorate ion attack. The OECD-NEA (Nuclear Energy Agency) guideline on packages for sea dumping of radioactive wastes recommends the use of a drum that is lined with concrete to provide a double-layered wall. In Japan and European countries, this type of container usually has a concrete lining 5 to 10 cm thick. Such a thick lining reduces the inner capacity of the drum by 35 to 65%, thereby necessitating the use of many drums to solidify radioactive wastes. What is more, the radioisotopes (hereunder sometimes referred to as RI) in the wastes may diffuse in an uncontrolled manner out of a corroded drum.

To cope with the recent shortage in the storage area available at nuclear facilities, the method of solidifying radioactive wastes with asphalt or plastics have recently been developed. This technique is effective to compact radioactive wastes into a smaller volume, but the asphalt or plastics are highly inflammable and are hazardous in a fire. The dangerous nature of this method is more apparent when the metal drum in which the radioactive wastes are solidified with asphalt or plastics is corroded. As a further disadvantage, permanent storage of radioactive wastes is impossible in a small country such as Japan. For economical use of storage areas, the best way is to dispose of radioactive wastes by dumping them in the sea or burying them under the ground when their radioactivity has decreased below a certain level after extended storage. The conventional metal drum based container is apparently not suitable for long-term surface storage or disposal under the ground, and the development of a new type of container that minimizes the reduction in the inner capacity and which remains stable for a prolonged period has been desired.

A container made of polymer-impregnated concrete (hereunder sometimes referred to as PIC), wherein a precast concrete container is impregnated with a monomer (e.g. methyl methacrylate or MMA) that is subsequently polymerized, is known; and it has high strength, long-term durability and can prevent the leaching of radioactive isotopes. But the concrete used does not have much higher impact resistance and is less refractory than concrete. Therefore, to prevent damage that may occur during shipping (e.g. by dropping thereof or other accidental impacts) or in a disaster such as an earthquake or fire, the PIC wall must have a thickness of at least 80 mm, but this again results in a great reduction in the inner capacity of the container.

A container made of steel fiber reinforced polymer impregnated concrete (hereunder sometimes referred to as SFRPIC) is also known. It is fabricated by impregnating a premolded vessel of steel fiber reinforced concrete (hereunder sometimes referred to as SFRC) with a polymerizable monomer which is subsequently polymerized and cured within the concrete. This SFRPIC container is far superior to a container not subjected to impregnation in respect of strength, impact resistance, corrosion resistance, chemical resistance and fire resistance. But as in the case of the PIC container, the SFRPIC version must have a wall thickness of about 50 mm to prevent accidental damage due to fire, dropping or other deleterious factors that may occur during handling. As a result, its inner capacity is too small to be effectively used as a container for surface disposal or as an isotactic container for sea disposal.

For the reasons stated above, it has been long desired in the art to develop a novel container for storage and disposal of radioactive or industrial wastes that is free from the defects of the conventional product.

SUMMARY OF THE INVENTION

A general object of the present invention is to provide a high integrity container having a three-layered structure that is suitable as a container for use in storage and disposal of radioactive wastes or inductrial wastes, as well as a process for fabricating such a container.

A more specific object of the present invention is to provide a high integrity container having a three-layered structure and a process for fabricating the same; said container comprising a metallic vessel as an outer layer, a concrete lining as an inner layer that is cast on the inner surface of said metallic vessel and which is reinforced with a reinforcing material and strengthened with an impregnant, and a polymerized and cured impregnant layer that is formed as an intermediate layer between said metal drum and the concrete lining.

Another object of the present invention is to provide a vacuum impregnating apparatus that is capable of very efficient and simple application of an impregnant to the concrete lining by using the metallic vessel as an impregnation vessel in the fabrication of a high integrity container having a three-layered structure.

Still another object of the present invention is to provide a method for removing air from between the outer and inner layers of a container of three-layered structure during the drying step of its fabrication.

A further object of the present invention is to provide a method and apparatus for simple detection of air leakage from a high integrity container having a three-layered structure.

BRIEF DESCRIPTION OF THE DRAWINGS

These and other objects, as well as the advantages of the present invention will be apparent by reading the following description taken in conjunction with the accompanying drawings, in which:

FIG. 4 is a graph of the results of Reference Examples 3 and 4 and Example 3.

DETAILED DESCRIPTION OF THE PREFERRED EMBODIMENTS

Figure 1:
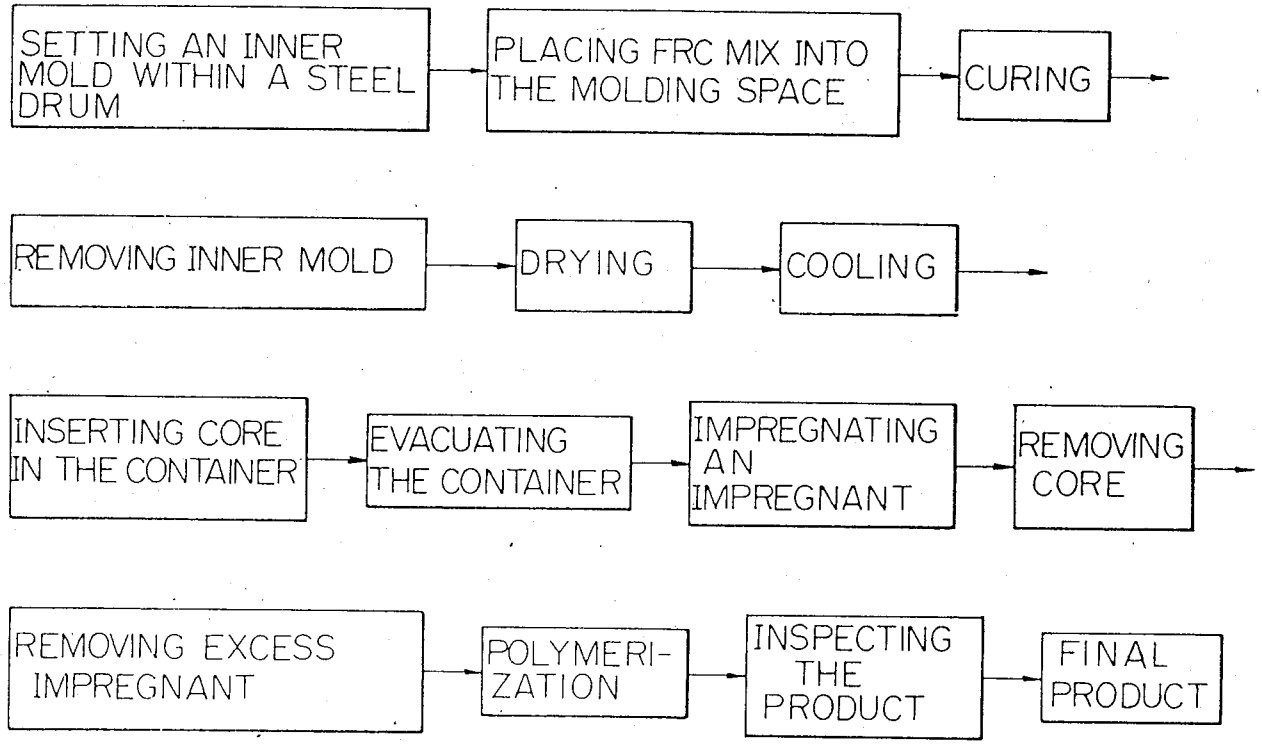
FIG. 1 is a flow sheet that illustrates one embodiment of the process of the present invention for fabricating a high integrity container of a three-layered structure.

The present invention relates to a high integrity container having a three-layered structure and a process for fabricating the same. The high integrity container of the present invention is suitable for use in storage and disposal of radioactive wastes or industrial wastes.

The present invention is the product of our studies for the improvement of conventional containers used in storage and disposal of radioactive wastes or industrial wastes. The invention is based on our finding that a container having long-term durability, good handling properties and maximum internal capacity can be fabricated by lining a metallic vessel with concrete fortified by a reinforcing material such as steel fiber, glass fiber, carbon fiber, polymer fiber or metal gauze and by impregnating the concrete with a polymer or inorganic material to make an integral structure.

In one aspect, the present invention provides a high integrity container having a three-layered structure and a process for fabricating the same. The container comprises a metallic vessel as an outer layer, a concrete lining as an inner layer that is reinforced with a reinforcing material and strengthened with an impregnant, and a polymerized and cured impregnant layer as an intermediate layer that is formed between said metallic vessel and concrete lining.

The respective layers of the high integrity container of the present invention are described hereunder. The concrete lining to be formed on the inner surface of the metallic vessel is made of various materials including cement paste which is a mixture of cement, water and an additive which may be a water reducing agent or an expansive admixture to prevent cracking, as well as mortar which is a mixture of cement, sand, water and the additive. The reinforcing material to be incorporated in the concrete lining includes steel fiber, glass fiber, carbon fiber, polymer fiber, lath and reinforcing bar or mesh. The steel fiber is preferred and it is incorporated in an amount of 0.5 to 2.0 vol % of the total concrete volume. These reinforcing materials improve the toughness, impact resistance, fatigue properties and fire resistance of the concrete lining. The effects of the reinforcing materials are generically described as the "reinforcement" of the concrete lining.

Examples of the impregnant used to strengthen the concrete lining include one or more radical polymerizable monomers selected from the group consisting of methylmethylacrylate, methylacrylate, ethylacrylate, styrene, alphamethylstyrene and acrylonitrile, or one or more polymerizable materials capable of forming a thermosetting resin selected from the group consisting of thermosetting polyesters and epoxy resins; and inorganic materials such as ethyl silicate, methyl silicate, water glass and sulfur. The radical polymerizable monomers may be used in combination with conventional cross-linking agents such as divinylbenzene, trimethylolpropane trimethacrylate and polyethylene glycol dimethacrylate. The radical polymerizable monomers and cross-linkable resins may be used together with other polymers. These impregnants increase the water impermeability and resistance to chemicals, seawater, acids and corrosion of the concrete lining and eliminate voids from the lining. The effects of the impregnants are generically described as the "strengthening" of the concrete lining.

Further, the surface of the concrete lining may be coated with a material such as polyethylene, epoxy resin, polyvinyl chloride, paraffin, waterglass, sulfur, etc. to give the concrete lining resistance to aromatic hydrocarbon solvents and ketone solvents, ether solvents and acids.

As described above, the concrete lining forming the innermost layer of the container of the present invention has incorporated therein steel fiber and other reinforcing materials to improve the toughness, impact resistance, fatigue properties and refractoriness of plain concrete. The concrete lining is also impregnated with an impregnant that is polymerized and cured to form a strong intermediate layer that has high water impermeability and improved resistance to chemicals, seawater, acids and the corrosive reaction between liquid radioactive wastes and the cement structure and eliminates voids from the lining to thereby prevent the leakage of RIs and provide a solidified product of uniform structure. The preferred thickness of the concrete lining is 15 to 35 mm in the breast (i.e. the side wall), 20 to 45 mm on the bottom and 15 to 35 mm on the top, and the exact value is properly determined depending upon the type of the waste to be contained, its form and the necessary degree of shielding. Thus, one feature of the container of the present invention is the thinness of the concrete lining, which hence allows for minimum reduction in the inner capacity of the container. The high integrity container suggested in the OECD-NEA guidelines that use a metal drum as an outer layer has a relatively thick concrete lining (50–100 mm) and provides a small inner capacity. For example, a container with a concrete lining 50 mm thick has an inner capacity of about 114 liters whereas another one of the same exterior dimensions having a 100 mm thickness has an inner capacity of only about 71 liters. By decreasing the thickness of the concrete lining and hence minimizing the reduction in the inner capacity of the container, a greater amount of radioactive wastes or industrial wastes can be put into the container, and as a result, more efficient and rapid handling in storage and disposal of the wastes can be accomplished. According to the present invention, the impregnant applied into the reinforced concrete lining is polymerized and cured by a suitable technique to improve the chemical resistance, corrosion resistance, water impermeability and durability of the concrete lining and eliminate internal voids from it so as to provide a complete seal against the leakage of RIs over an extended period.

The metallic vessel as the outermost layer of the high integrity container of the present invention is made of steel, stainless steel, aluminum or other metals, and its cross section may be circular (drum shaped), square, hexagonal or other shapes. The material and shape of the metallic vessel should be properly determined in accordance with the type of wastes to be put into the container, as well as the environmental and other conditions under which the container is to be placed. Preferably, a metal drum is used in the present invention, and a fully-removable head steel drum (JIS Z 1600) having a capacity of 200 liters and a wall thickness of 1.2 to 1.6 mm is particularly preferred. A drum of any material and shape may be used so long as it is composed of a cylindrical body member shaped from a metal sheet joined at its two ends by seam welding or butt welding, a bottom member the peripheral portion of which has a curled joint with the lower peripheral edges of the body member, and a top cover that is fastenable to the body member. The other requirements for the drum are: a firm weld and a securely curled joint; both inner and outer surfaces of the drum free from deleterious defects such as scratches, wrinkles or rust; and the drum's retention of airtightness.

The polymerized and cured impregnant layer that is formed between the outer metallic vessel and inner concrete lining is the third component of the high integrity container of the present invention and is essential for achieving the intended objects of the present invention in combination with the other two layers. As described hereinabove, the concrete lining is made of plain concrete reinforced with a reinforcing materials and is strengthened with a polymerized and cured impregnant. After forming the reinforced concrete lining on the inner surface of the metallic vessel, the lining is cured and dried at a temperature higher than 100° C. Then, the lining shrinks to form a continuous gap between the metallic vessel and the lining, and for a metal drum having a capacity of 200 liters, this gap is about 0.1 to 1 mm wide. A charged impregnant fills the voids in the concrete lining, as well as the continuous gap between the outer metal layer and the lining. By application of heat or other suitable means, the impregnant in the voids and that in the gap are simultaneously polymerized and cured to form an intermediate impregnant layer. This impregnant layer enables the concrete lining to be firmly adhered to the metallic vessel and assures the integrity of the resulting high integrity container. At the same time, the impregnant layer helps the concrete lining to retain its durability and water-tightness even if the metallic vessel becomes corroded. The impregnant layer between the metallic vessel and the concrete lining is continuous with the polymerized and cured impregnant in the voids in the lining and therefore these layers are intended, and as a result a firm concrete protecting layer is formed. The effects of the intermediate impregnant layer are described in detail in the Examples and Reference Examples that follow later in the specification.

The high integrity container according to one of the most preferred embodiments of the present invention uses a steel drum as the outer metallic vessel, steel fibers as the reinforcing material, and a polymerizable monomer as the impregnant. This container and a process for fabricating the same are hereunder described by reference to FIG. 1. A mix comprising cement, water, aggregate and steel fibers in selected proportions is mixed and placed into the space between the steel drum (as the outer mold) and an inner mold made of a suitable material. The mix may contain a suitable amount of an expansive admixture to prevent cracking. The poured concrete is then cured with steam at about 60° C. for 3 hours. After the curing, the inner mold is removed and the lining is dried by heating at 100°–150° C. for 8 to 48 hours. The heating temperature is correlated with the heating period, and if the heating period is in the range of 8 to 48 hours, the temperature should not exceed 150° C. in order to avoid any possibility of breakage of the structure of the concrete. After the concrete lining has been dried, a core is inserted in the container, and then the steel drum is closed with a top cover and evacuated with a vacuum pump. The concrete lining is strong enough to prevent the steel drum from deforming during the evacuating step. After the evacuation step, a polymerizable monomer is charged under reduced pressure to a level above the top of the concrete lining, and then, after allowing the pressure within the container to return to atmospheric pressure or applying a forced pressure within the container, impregnating said impregnant into the voids of the concrete lining and also into the gap between said metallic vessel and the concrete lining. The core is removed and then excess monomer is removed by a vacuum pump, etc. The remaining monomer is polymerized by thermal polymerization, thermal polymerization under pressure (0.1–5 kg/cm$^2$ gauge, preferably 0.2–3 kg/cm$^2$ gauge), or radiation-initiated polymerization. When the impregnant is an organic monomer, a conventional polymerization initiator such as an organic nitrogen compound (e.g. azobisiso-butyronitrile) or an organic peroxide (e.g. benzoyl peroxide or t-butyl hydroperoxide) is used. Since the polymerization is effected in a closed system, there is minimum evaporation of the monomer from the surface of the container, and a polymer film is formed between the steel drum and the concrete lining to improve the durability of the final product. Therefore, one advantage of the process of the present invention is the economy of avoiding the use of a special apparatus for impregnating the concrete lining. Another advantage is that a high integrity container having long-term durability and protection against the leakage of RIs can be fabricated without requiring any modification to the existing nuclear facilities which use metal drums to store radioactive wastes. When the impregnant is an inorganic material such as ethyl silicate, methyl silicate, water glass or sulfur, the desired container can be fabricated by the same method except that no special catalyst is used in the polymerization step.

The high integrity container of the present invention fully retains the advantages of the conventional steel drum while eliminating its defects. As already mentioned, the high integrity container described in the OECD-NEA guidelines is fabricated by forming a lining of plain concrete 50 to 100 mm thick on the inner surface of a metal drum by centrifugal formation or casting. But this is not enough for the object of providing the metal drum with a thin layer of fiber-reinforced concrete lining that is dense and free from pin holes. To attain this object, we determined effective methods of mixing the concrete and giving it the desired form. In addition, we devised an effective way to prevent the formation of cracks in the concrete lining when it is dried prior to the impregnation step, as well as a method to make use of the metal drum as an impregnation vessel. These improvements over the conventional technique are hereunder described.

The step of impregnating the concrete lining with an impregnant is very important for the purpose of fabricating a high integrity container having improved physical properties. What is more, one application of the fabricated container is the storage and disposal of radioactive wastes, so complete and efficient impregnation of the concrete lining is necessary. The technique of impregnating a precast concrete container with a polymerizable monomer or a like impregnant and subsequently polymerizing and curing said impregnant within the concrete is known, but this method requires an expensive impregnation vessel that is large enough to accommodate the concrete vessel. Furthermore, the concrete vessel must be carried to the impregnation vessel which is usually fixed on a separate site. Coupled with the heavy weight of the concrete vessel, these factors reduce the efficiency of the impregnation operation and increase the danger to the operator. As a result of various studies to avoid these problems, we have come up with a vacuum impregnation apparatus that requires low initial cost and is simple to use. By using this apparatus, the high integrity container of the present invention can be fabricated safely and efficiently.

Figure 2:
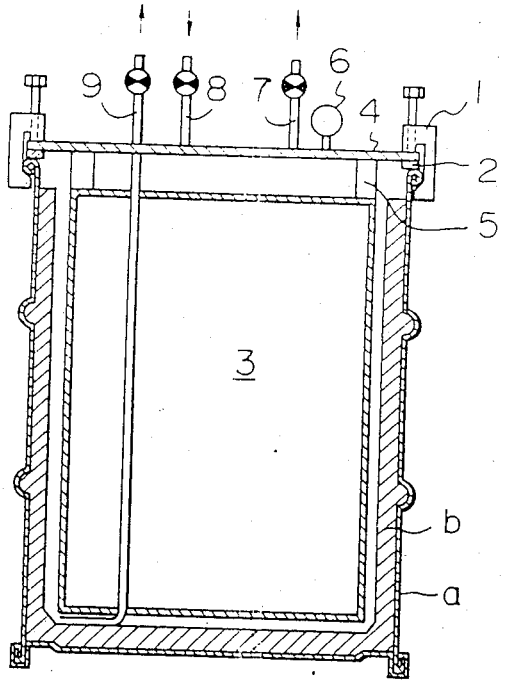
FIG. 2 is a side-elevational sectional of a vacuum impregnating apparatus as applied to the high integrity container.

FIG. 2 is a side-elevational section of one embodiment of the vacuum impregnation apparatus as applied to the fabrication of the high integrity container of the present invention. A steel drum (a) lined with steel fiber reinforced concrete (b) is closed with a steel top cover (4) which is secured to the steel drum with a suitable fastener, say a vice (1) mounted on two opposite sides of the drum. On top of the cover (4) are mounted a pressure reducing unit (7) for evacuating the container, a pressure gauge (6) for measuring the pressure in the container, a supply pipe (8) for feeding in an impregnant, and a suction pipe (9) for drawing out excess impregnant. The procedure of impregnation with this apparatus comprises the following: (1) use the pressure reducing unit to evacuate the container to 1 mmHg or less over a period of about one hour; (2) inject the impregnant into the container through supply pipe (8); (3) increase the pressure in the container to one atmosphere for the purpose of impregnation; and (4) draw off excess impregnant through suction pipe (9). The impregnation operation can be accelerated by applying a pressure of about 0.5 kg/cm$^2$ gauge. If a pressure of more than 0.5 kg/cm$^2$ gauge is used, the bottom of the steel drum should be reinforced to prevent its bulging. A core (3) is preferably used to avoid excessive use of the impregnation, and for higher efficiency of the operation, core (3) is preferably joined to top cover (4) by linking means (5).

FIG. 2 shows the most preferred embodiment of the vacuum impregnation apparatus that is used in the present invention, and as will be readily understood by those skilled in the art, various changes and modifications may be made depending on the conditions for fabricating the high integrity container of the present invention. If economy is of secondary importance, suction pipe (9) through which excess impregnant is drawn off or core (3) may be omitted. A switch valve may be used to connect pressure reducing apparatus (7) with supply pipe (8). In this case, the vacuum system may be contaminated by impregnant, but that is a technically soluble problem. The vacuum impregnation apparatus described above can also be used with a concrete vessel having no steel drum, and in this case, the same procedure is repeated after placing the full body of the concrete vessel within a steel container. Therefore, it should be understood that the metal drum forming the outermost layer of the high integrity container of the present invention serves as the impregnation vessel of the vacuum impregnation apparatus.

As described earlier in this specification, one feature of the process for fabricating the high integrity container of the present invention is that the concrete lining formed on the inner surface of the metallic vessel is dried at 100° C. or higher after it is cured. During this drying step, water vapor is evolved from the concrete lining and fills the gap formed between the metallic vessel and concrete lining as a result of the shrinkage of the concrete, and an internal pressure results. Therefore, the generated vapor is vented. In a preferred embodiment, the metallic vessel has a steel body member 1.2 mm or 1.6 mm thick which is strong enough to withstand the resulting vapor pressure, but the bottom member is not as strong as the body member and deforms under the vapor pressure. For example, a steel drum having a wall thickness of 1.2 mm bulges by about 10 mm at an internal pressure of 0.5 kg/cm$^2$ gauge, and about 18 mm at 1.0 kg/cm$^2$ gauge, and fails at 2.0 kg/cm$^2$ gauge. Therefore, it is necessary to remove vapor that is evolved between the metallic vessel and concrete lining during the drying step of the fabrication of a high integrity container. In the course of our research for developing a process for fabricating a high integrity container, we have discovered three methods for removing the vapor evolved during the step of drying the concrete lining. According to the first method, pipes of a heat resistant material through which vapor may pass are provided in contact with the inner surface of the bottom and side walls of the metallic vessel before it is lined with concrete. The preferred pipe diameter is in the range of 0.5 to 1.0 mm. If the diameter is less than 0.5 mm, evacuation efficiency is low, and if it is more than 1.0 mm, the pipes are compressed between the metallic vessel and the concrete lining which reduces the evacuation efficiency. In the second method, holes of a diameter of about 10 mm are made through the concrete lining to the bottom of the metallic vessel. Vapor evolved between the concrete lining and the metallic vessel during the drying step is let out through these holes, and after completion of the drying operation, the holes are closed with a powder such as cement or fly ash, or a suitable adhesive. If a powder such as cement or fly ash is used, the closure step preferably precedes the step of impregnation with a polymer, and if an adhesive is used, the closure step may follow the impregnation step. According to the third method, an air-permeable material such as glass wool or porous stone is put on the inner surface of the bottom of the metallic vessel before it is lined with concrete. When the concrete lining is cured and dried, evolved vapor is let out through the open space provided by the porous material and gap formed between the shrinking concrete and the metallic vessel.

The high integrity container of the present invention is primarily used in storage and disposal of radioactive wastes, so its structural integrity is important and must be thoroughly and carefully checked during and after its fabrication. An air leak test is indispensable to the quality control and inspection of high integrity containers. Therefore, in our research project on the development of a high integrity container, we also worked out a simple method and apparatus for detecting air leakage from the concrete lining.

Figure 3:
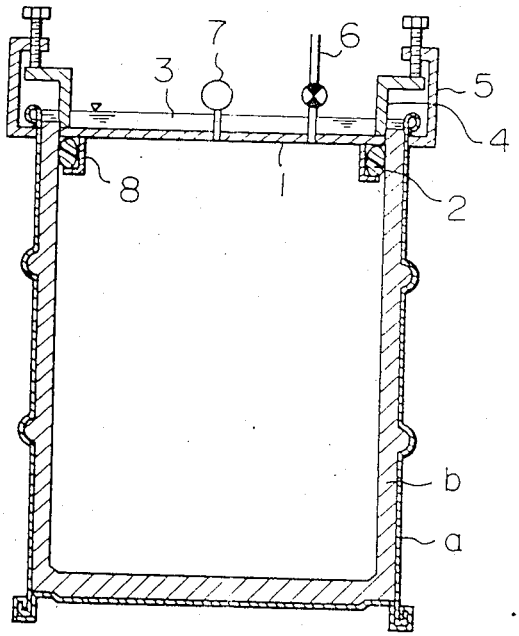
FIG. 3 is a side-elevational section of an air leak detector as applied to the high integrity container.

The most preferred embodiment of the apparatus used in checking the high integrity container of the present invention for air leakage is hereunder described by reference to FIG. 3 which is a side-elevational section of the apparatus when connected to the high integrity container of the present invention. As shown, a metal drum (a) is closed with a steel top cover 10 to 15 mm thick that is placed on a position slightly below the upper end of the concrete lining (b) and which is firmly secured to the overall container by means of a suitable fastening device, say a vice (5) equipped with a supporting tool. Before placing the top cover (1) in position, a loop of inflated rubber tube (2) is provided that is pressed against the inner wall of the concrete lining a few centimeters below its top end. The pressure within the rubber tube is held slightly higher than that in the container and at the same time, the tube is retained on a supporting device, so there is no possibility that the tube will be dislodged during testing. The top cover (1) is equipped with a pressure applicator (6) that supplies air into the container and a pressure gauge (7) for measuring the pressure within the container. After setting up the testing equipment by the above procedure, water is poured into the space formed above the top cover until it is about 2 cm deep. Then, air is pumped into the container through the pressure applicator (6). Any crack or pin hole in the concrete lining can be visually detected by the presence of bubbles in the water that are formed by the air passing through the interface between the metal drum and the concrete lining. Bubbles may also be evolved on account of air leakage from the gap between the rubber tube (2) and the concrete lining, but they need not be taken into account in the leakage test because they occur in a place different from that where the bubbles due to cracks or pin holes are evolved and can be readily distinguished from them. As described above, the present invention provides a very simple method and apparatus for air leakage testing to check if the concrete lining of the high integrity container of the present invention has any deleterious surface flaw such as pin holes or cracks.

The features and resulting advantages of the present invention are hereunder described by reference to the following Examples and Reference Examples but as will be readily understood by those skilled in the art, various changes and modifications can be made without departing from the scope and spirit of the present invention. Typical modifications will concern the material and shape of the metallic vessel, as well as the amounts of the reinforcing material and impregnant and the proportions of the ingredients which make up the concrete lining.

REFERENCE EXAMPLE 1

A steel drum with a wall thickness of 1.2 mm was equipped with a mold designed to prevent the formation of concrete lining on the bottom. Cement (450 kg/m$^3$) was mixed with 187 kg/m$^3$ of water, 865 kg/m$^3$ of sand, 770 kg/m$^3$ of gravel, 80 kg/m$^3$ of steel fiber and 3 kg/m$^3$ of a water reducing agent, and the resulting mix was placed into the space between the steel drum and the inner mold and then vibrated. After pre-curing for 2 hours, the concrete was cured with steam at 60° C. for 3 hours. After standing 3 days, the concrete cylinder having an average wall thickness of 25 mm was recovered from the steel drum and subjected to a pressure test. It was found to have a cracking resistance of 905 kg/m.

EXAMPLE 1

A sample of concrete lining was prepared from the same formulation as in Reference Example 1. It was left overnight, and on the following day, it was dried at 150° C. for 12 hours and cooled. The steel drum was closed with a top cover equipped with a vacuum valve and evacuated to 1 mmHg over a period of 1 hour. Methyl methacrylate having 1% of azobisisobutyronitrile as an initiator was charged into the container and the pressure in its interior was then restored to one atmosphere before starting impregnation for a period of 1.5 hours. After removing excess monomer, the impregnant was subjected to thermal polymerization with steam (90° C.) for 1 hour. On the following day, a cylindrical sample of SFRPIC having an average wall thickness of 25 mm was recovered from the steel drum. The sample was subjected to a pressure test and was found to have a cracking resistance of 2680 kg/m. The concrete lining adhered to the steel drum so firmly that the drum had to be carefully removed to prevent breakage of the lining.

REFERENCE EXAMPLE 2

A sample of concrete lining having a bottom wall 30 mm thick was prepared and cured as in Reference Example 1. After leaving the sample for 3 days, a cylindrical concrete container with a bottom was removed from the steel drum. The container had average wall thicknesses of 26 mm and 30 mm in the breast and the bottom, respectively. The container was filled with water and subjected to a water leakage test by varying the water pressure. No leakage occurred at normal pressure, but at 1 kg/cm$^2$ gauge, water oozed out at several points, and the container broke at 1.9 kg/cm$^2$ gauge.

EXAMPLE 2

A sample of the same type as prepared in Reference Example 1 was impregnated with methyl methacrylate under the same conditions as used in Example 1. A cylindrical concrete container with a bottom was recovered from the steel drum. The wall thicknesses in the breast and bottom were the same as in Reference Example 2, and as in Example 1, the concrete lining adhered strongly to the steel drum which therefore had to be carefully removed. The container was subjected to a water leak test as in Reference Example 2 and no leakage occurred when it was held under a water pressure of 1 kg/cm$^2$ gauge for 1 hour. It broke at an increased pressure of 4.0 kg/cm$^2$ gauge.

The samples prepared in Reference Examples 1 and 2 were unimpregnated SFRC containers whereas those of Examples 1 and 2 were prepared by removing the outermost layer (steel drum) from a three-layered container. The purpose of the tests conducted in these examples was to determine the physical strength of the respective samples after corrosive attack of the steel drum. The data shows that the two samples of the high integrity container of the present invention retained the inner concrete lining of high strength and water tight structure and exhibited long-term durability even after the outer steel drum had become corroded.

REFERENCE EXAMPLE 3

An SFRC lining was formed on the inner surface of a steel drum using the same formulation as in Reference Example 1, and it was left to stand for 3 days. The drum was removed from the lining and SFRC samples measuring 120 mm wide, 150 mm long and 20 mm thick were cut out of the lining with a diamond cutter. The samples were immersed in an aqueous solution of 2% $H_2SO_4$ for 2,000 hours to check the change in the weight of the samples. The results are shown in the graph of FIG. 4 by-X-.

REFERENCE EXAMPLE 4

An SFRC lining was formed on the inner surface of a steel drum using the same formulation as in Reference Example 1, and it was left for 3 days. The concrete vessel was recovered from the steel drum, dried at 150° C. for 12 hours, cooled, put in an impregnation apparatus where the concrete layer was impregnated with methyl methacrylate monomer under the same conditions as in Example 1 and the monomer was thermally polymerized by heating with steam (90° C.) for 1 hour. SFRPIC samples of the same dimensions as in Reference Example 3 were cut out of the concrete wall and immersed in aqueous solution of 2% $H_2SO_4$ for 2,000 hours to check the change in the weight of the samples. The results are shown in the graph of FIG. 4 by solid dots (●).

EXAMPLE 3

An SFRPIC container was formed as in Example 1 and separated from the steel drum. Samples of the same dimensions as in Reference Example 3 were cut out of the concrete wall and immersed in aqueous solution of 2% $H_2SO_4$ for 2,000 hours to check the change in the weight of the samples. The results are shown in the graph of FIG. 4 by open dots (○).

FIG. 4 shows that the SFRC samples of Reference Example 3 had a weight loss of 10% or more when they were immersed in dilute $H_2SO_4$ over a period of 2,000 hours. The samples of Reference Example 4 had a weight loss of about 0.5% over the same period. The samples of Examples 3 (according to the present invention) suffered a weight loss of only about 0.1% even when they were immersed in an aqueous solution of 2% $H_2SO_4$ for 2,000 hours. The container fabricated in Reference Example 3 was an unimpregnated SFRC container. The product of Reference Sample 4 was an SFRPIC container fabricated by the conventional method. The container of Example 3 had a three-layered structure and was fabricated according to the method of the present invention. Each of the containers was stripped of the outer steel drum and subjected to the acid resistance test on the assumption that the drum had become corroded as a result of long-term storage. The data obtained shows that the high integrity container of the present invention will prove much more durable than the conventional products against acidic conditions (such as in underground water) and other hostile conditions (shown as on a deep sea bed) even when the outer metallic vessel is corroded after long-term storage in the ground or sea. The primary reason for this great durability is that the impregnant layer formed between the metallic vessel and the concrete lining is continuous with the impregnant polymerized and cured within the voids in the concrete lining, thereby providing a strong protective film on the concrete lining.

EXAMPLE 4

A sample of the same type as prepared in Reference Example 2 except for using the formulation including an expansive admixture (CSA, produced by DENKI KAGAKU KOGYO: 60 kg/m$^3$) to prevent cracking and cement (390 kg/m$^3$). The resulting concrete product shows decrease in crack-generating rate of about 20% over that in the absence of the expansive admixture.

EXAMPLE 5

A sample of the same type as prepared in Example 2 except for applying 0.5 kg/cm$^2$ gauge pressure while curing the impregnant. The resulting container is about 20 times more airtight from one cured under atmospheric pressure.

By comparing the Examples and Reference Examples, it will be apparent that the high integrity container of the present invention has a concrete lining mechanically strong and chemically durable long after the outer metallic vessel is attacked by corrosion. Therefore, the container is suitable for use in storage and disposal of radioactive wastes and industrial wastes.

What is claimed is:

1. A process for fabricating a high integrity container having a three-layered wall structure, for the burial of intermediate and low level radioactive wastes for a term of at least about one hundred years, comprising:

placing an inner mold within a metal vessel to define a space therebetween;

placing an hydraulic concrete mix, comprising cement, water, aggregate, a fibrous reinforcing material selected from the group consisting of steel fibers in an amount up to two volume per cent, glass fibers, carbon fibers and polymer fibers, and an additive of a water reducing agent or an expansive admixture to prevent cracking, into the space between said metal vessel and said inner mold;

curing the hydraulic concrete mix with steam to form a solidified concrete liner;

removing the inner mold, and drying the concrete liner at about 100°–150° C. for about 8–48 hours, whereby a thin gap is formed between the vessel and the concrete liner, and venting evolved water vapor from said thin gap;

inserting a core within the concrete liner and closing the metal vessel with an air-tight top cover;

applying vacuum to evacuate air and vapor from within said metal vessel;

charging under reduced pressure to the interior of said metal vessel a liquid impregnant to a level above the top of said concrete liner;

returning the pressure within said metal vessel to approximately at least atmospheric pressure, and allowing the increased pressure to effect impregnation of voids within said concrete liner and to effect filling of said thin gap with said liquid impregnant;

removing the core and excess liquid impregnant from within said liner, and solidifying said liquid impregnant under increased pressure up to 5 kg/cm$^2$ gauge to form an impervious impregnated concrete liner and a thin intermediate layer between said metal vessel and said concrete liner, said thin intermediate layer being integral with said impregnant within said concrete liner, said thin intermediate layer adhering to the interior of said metal vessel; and testing the resultant high integrity container for air leaks.

2. A process according to claim 1 wherein said impregnant is one or more radical polymerizable monomers selected from the group consisting of methylmethacrylate, methylacrylate, ethylacrylate, styrene, alphamethylstyrene and acrylonitrile, or one or more polymerizable materials capable of forming a thermosetting resin selected from the group consisting of thermosetting polyesters and epoxy resins.

3. A process according to claim 2 wherein curing the impregnant is carried out by thermal polymerization under a pressure of 0.1 to 5 kg/cm$^2$ gauge.

4. A process according to claim 2 wherein curing the impregnant is carried out by thermal polymerization under a pressure of 0.2 to 3 kg/cm$^2$ gauge.

5. A process according to claim 1 wherein said impregnant is an inorganic material selected from the group consisting of ethylsilicate, methylsilicate, waterglass and sulfur.

6. A process according to claim 1 wherein said metallic vessel is a steel drum.

7. A process according to claim 1 wherein the surface of the resulting concrete lining is further coated with a material having resistance to aromatic solvents, ketone solvents, ether solvents, and acids, selected from the group consisting of polyethylene, epoxy resin, polyvinyl chloride, parrafin, waterglass and sulfur.

8. A process according to claim 1 comprising incorporating reinforcing bar or mesh within said hydraulic concrete mix placed within the space between said inner mold and said metal vessel.

9. A process according to claim 1, wherein said fibrous reinforcing material comprises said steel fibers in an amount of 0.5–2 volume percent of the total concrete volume.

10. A process according to claim 1, wherein said core and said air-tight top cover are unitary.

11. A process according to claim 1, wherein said evacuation is effected for about one hour.

12. A process according to claim 1, wherein said impregnant is a polymerizable monomer, and said solidification comprises polymerizing said monomer to form a polymer impregnated concrete liner and a thin polymer intermediate layer between said metal vessel and said concrete liner, said thin polymer layer being integral with the polymer impregnated within said concrete liner.

13. A process according to claim 1, wherein said venting of elongated water vapor from said thin gap comprises removing the vapor evolved during the step of drying the concrete liner.

14. A process according to claim 1, wherein said curing with steam is at about 60° C. for about three hours.

* * * * *